United States Patent [19]

Durenec

[11] 4,388,808

[45] Jun. 21, 1983

[54] SWASH PLATE DRIVING MEANS FOR CRYOGENIC COOLERS

[75] Inventor: Peter Durenec, Annandale, Va.

[73] Assignee: The United States of America as represented by the Secretary of the Army, Washington, D.C.

[21] Appl. No.: 349,494

[22] Filed: Feb. 17, 1982

[51] Int. Cl.[3] ..... F25B 9/00

[52] U.S. Cl. ..... 62/6; 60/520; 417/271

[58] Field of Search ..... 62/6; 417/271; 60/520

[56] References Cited

U.S. PATENT DOCUMENTS

| | | | |
|---|---|---|---|
| 2,272,925 | 2/1942 | Smith | 62/6 |
| 2,468,293 | 4/1949 | Du Pre | 62/6 |
| 3,183,662 | 5/1965 | Korsgren, Sr. | 62/6 |
| 3,315,490 | 4/1967 | Berry et al. | 62/6 |
| 3,478,511 | 11/1969 | Schwemin | 62/6 |
| 4,282,716 | 8/1981 | Momose et al. | 62/6 |

*Primary Examiner*—Ronald C. Capossela

*Attorney, Agent, or Firm*—Robert P. Gibson; Milton W. Lee; Max L. Harwell

[57] ABSTRACT

Swash plate driving means for cryogenic coolers wherein multiple compressors and regenerators are driven. The swash plate driving means may drive one or more compressors off one or both sides of each swash plate, and one or more regenerators may simultaneously be driven by separate swash plates. The swash plates are formed to provide flat topped and bottomed repetitive pressure waves.

14 Claims, 8 Drawing Figures

SWASH PLATE DRIVING MEANS FOR CRYOGENIC COOLERS

The invention described herein may be manufactured, used, and licensed by the U.S. Government for governmental purposes without the payment of any royalities thereon.

BACKGROUND OF THE INVENTION

1. Field of the Invention

The invention is in the field of mechanically driven cryogenic cooler compressors and regenerators using rotating swash plates as the linear drive for the piston and displacer rods.

2. Description of the Prior Art

Previous cryogenic cooler compressors and regenerators have generally made use of the cam shaft type drives for piston action to provide modulated pressure waves in the closed cycle working fluid. Also, generally the number of compressors driven by the cam shaft type drives is limited to one. The present invention provides for the use of a plurality of compressors and regenerators driven by the swash plate driving means.

SUMMARY OF THE INVENTION

The present invention may be implemented in various forms, of which many of these forms are illustrated in the present specification and drawings. The swash plate driving means may drive only the compressor means to provide split cycle coolers or may drive both the compressor means and the regenerator means to provide integral cycle coolers. The swash plate driving means is preferably comprised of a swash plate connected at each end of a shaft that is rotated by an electric motor. Each swash plate may also drive from only one side of the plate or from both sides of the plate. Compressor means and regenerator means are driven from separate swash plates, herein called respectively the compressor swash plate and the regenerator swash plate. The regenerator swash plate that drives the regenerator means has a flat top portion on the upper inclined portion that extends through about 35% of the entire slider face of the swash plate upon which the rider portion of the displacer shaft of the regenerator means sides. The compressor swash plate may also have a flat top portion on the upper inclined portion to provide flat topped compressor waves.

Advantages of the present swash plate driving means for cryogenic coolers are as follows. The swash plates have potential for driving a plurality of piston rods off one swash plate and for driving a plurality of displacer shafts off another swash plate. There are small torque variations, and the coolers absorb vibration and noise. The swash plate driving means has bellows on the low pressure side of the piston rods and the displacer shafts to prevent contamination of the working coolant fluid with the lubricants, such as cryogenic grease or oil, used in the cavities where the swash plates operate. The piston rods and displacer shafts travel with very little lateral motion. The various compressors operating off the compressor swash plate may provide precooling stages for a multistage cooler, provide cooling for a cluster of displacer regenerators within one dewar, or provide cooling for a plurality of separate displacer regenerators. The plurality of compressors and regenerators operating off the swash plate driving means occupies a smaller space. The swash plate driving means conveniently operates in cooperative piston rods and displacer shaft drives in the integral Stirling cycle with one of the plurality of compressors operating from the compressor swash plate simultaneously with one of the corresponding plurality of regenerators operating from the regenerator swash plate so that the necessary variations in the compression and expansion volumes are achieved. The driving means also operates in the split Stirling cycle wherein a plurality of compressors driven by the compressor swash plate drive a plurality of regenerators remotely by working fluid feed lines with no regenerator swash plate drive used.

FIGS. *7a* and *7b* illustrate the geometry of the regenerator swash plate.

DETAILED DESCRIPTION OF THE EMBODIMENTS

Figure 1:
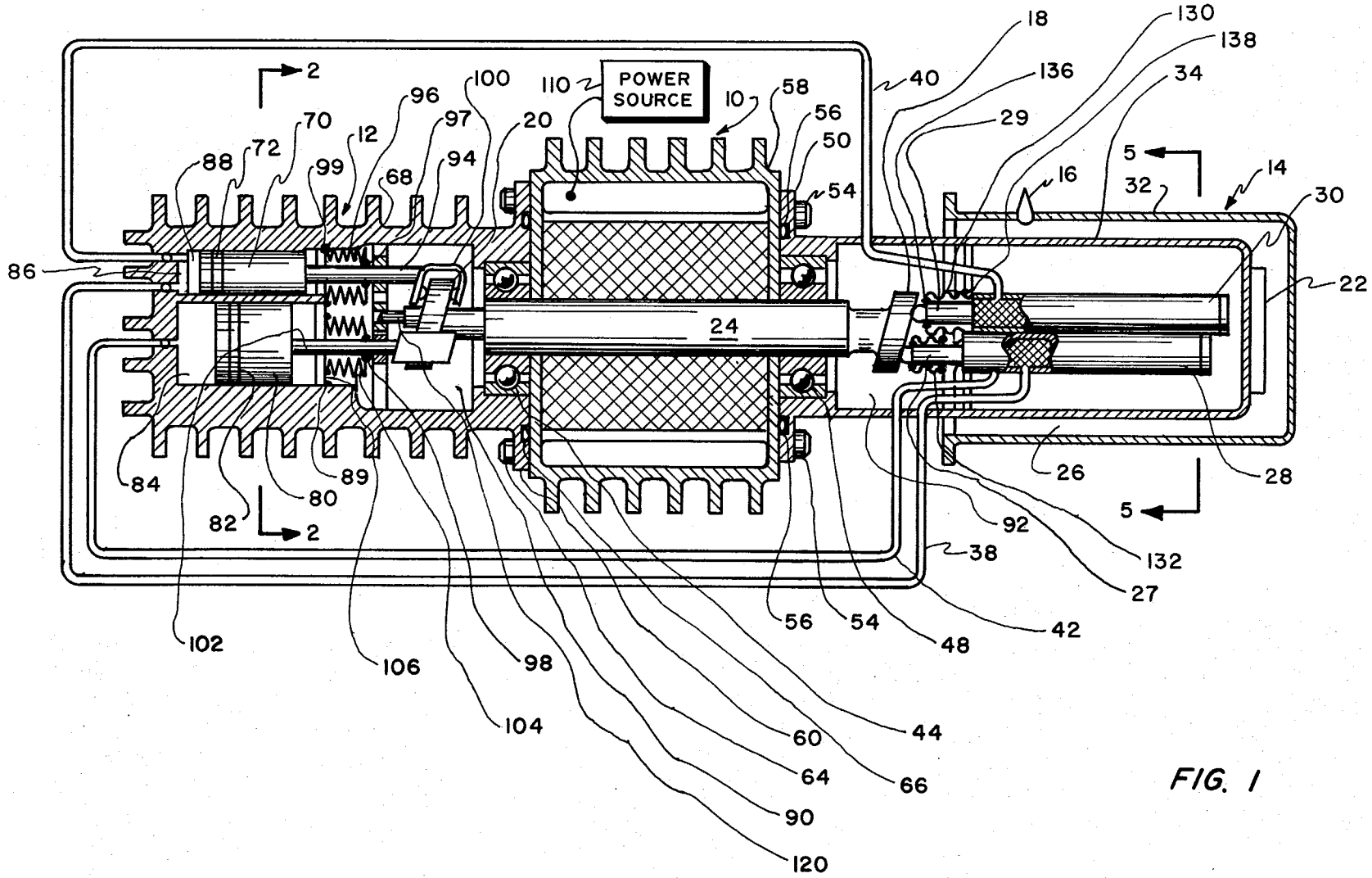
FIG. 1 is a sectional view of a swash plate driven cryogenic cooler in accordance with one embodiment of the present invention.
Figure 3:
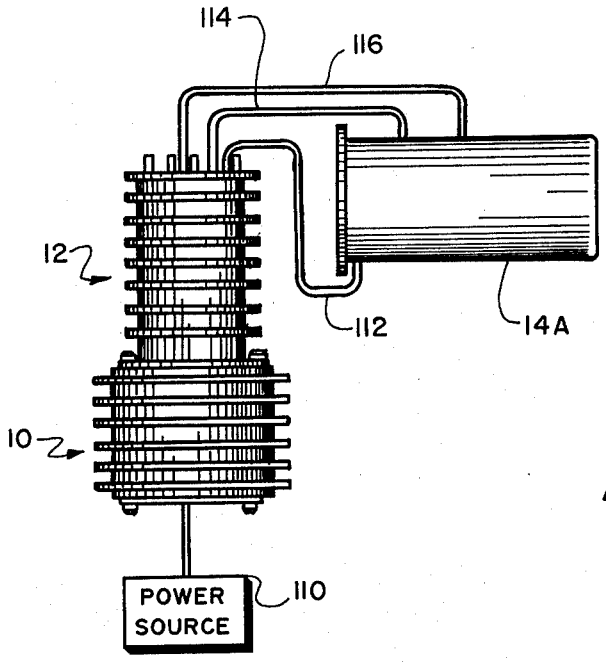
FIG. 3 illustrates a Stirling split cycle embodiment of the present invention having precooled stages.
Figure 4:
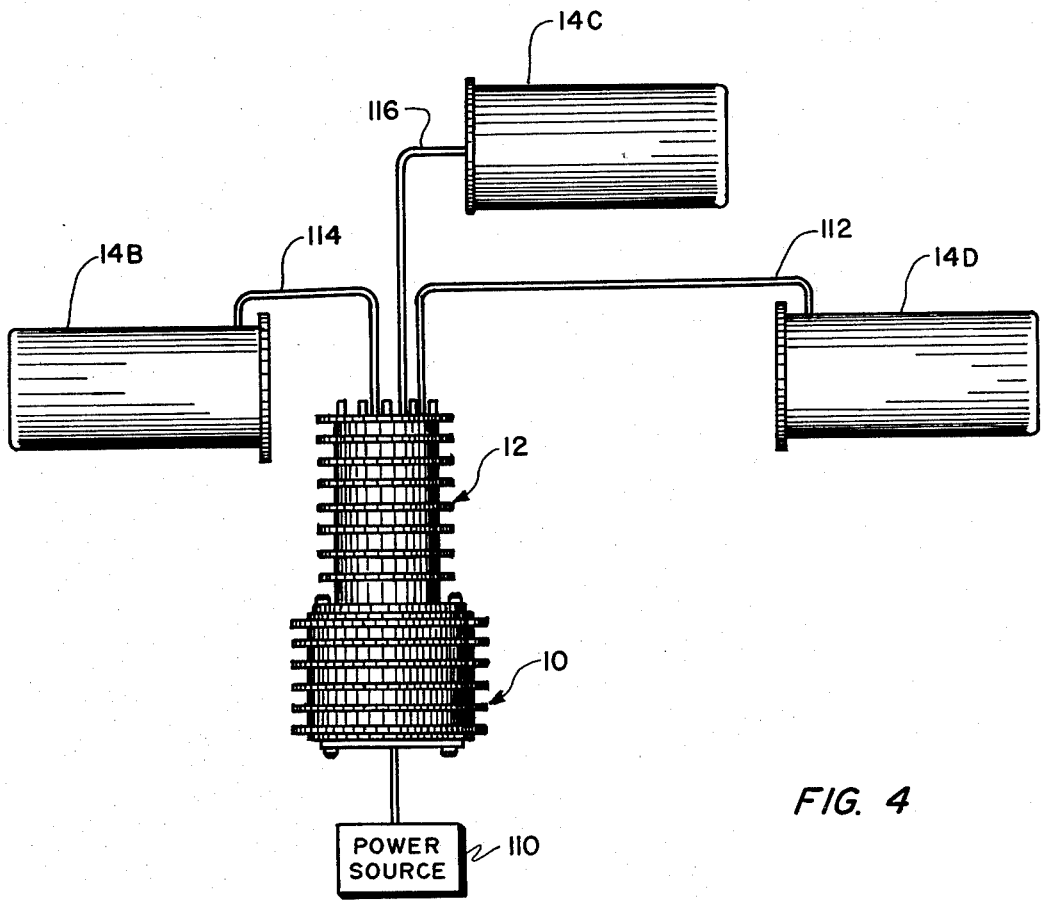
FIG. 4 illustrates still another Stirling split cycle embodiment of the present invention having separate cooler regenerators.

FIG. 1 diagrammatically shows a swash plate driving means which is comprised of a rotating means, such as an electric motor 10, having power source 110 connected thereto for rotating shaft 24, which has a compressor swash plate 20 on a compressor means 12 end and a regenerator swash plate 18 on a regenerator means end 14. Various type electric motors may be used to drive shaft 24. The electric motor 10 and the compressor means 12 housing 68 have fins thereon to dissipate heat therefrom. The regenerator means 14 is shown in the integral Stirling cycle in FIG. 1. However, the regenerator means may be connected to the drive and compressor means in the split cycles as illustrated in FIGS. 3 and 4 wherein the regenerators are driven by pressure waves in the working fluid supplied thereto through feed lines 112, 114, and 116 from pressure take offs on compressor means 12, and not by the regenerator swash plate 18. FIG. 3 illustrates a three stage regenerator cooler 14*a* with the inputs from the feed lines being the input to each separate regenerator. FIG. 4 illustrates three separate regenerator coolers 14*b*, 14*c*, 14*d* that are individually fed by feed lines 112, 114, and 116 wherein each cooler may have a different power rating, say typically $\frac{1}{4}$ watt, $\frac{1}{2}$ watt, and 1 watt.

Figure 5:
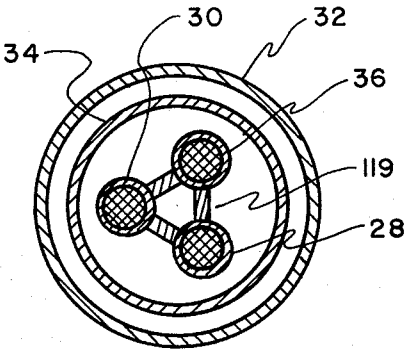
FIG. 5 is a cross-sectional view of the regenerator means end of the cooler taken along lines 5—5 in FIG. 1.

Referring now more closely to FIG. 1, motor 10 has the compressor housing 68 connected to one side of motor housing 58, over an air tight seal 66, by flange 60 and a plurality of screws 64 screw threadably connected to the motor housing through flange 60. Likewise, the regenerator means 14 is connected on the other side of motor housing 58 by screw threadably connecting the flange 50 of housing 14 over a seal 56 by a plurality of screws 54. The motor shaft 24 is rotated on rotary seals 44 and 48. As shaft 24 rotates, the swash plates 18 and 20, both of which are hard connected to the shaft, respectively drive a plurality of displacer shafts 27, 29 and (one that is not shown in FIG. 1) and a plurality of compressor pistons 94, 102, and 120. It should be noted here that even though only three separate displacer-regenerators 28, 30, and 36 (FIG. 5 cross-section) and three separate compression cylinders 70, 80, and 71 (FIG. 2 cross-section) are shown, the present embodiments are by no means limited to three but may be comprised of up to any number that the swash plates can physically handle. To provide smooth operation, the piston rods and displacer shafts should be equally spaced around the swash plates. It should further be noted that the piston rods and displacer shafts may be driven off both sides of the swash plates to provide more cooling per space utilized.

Figure 2:
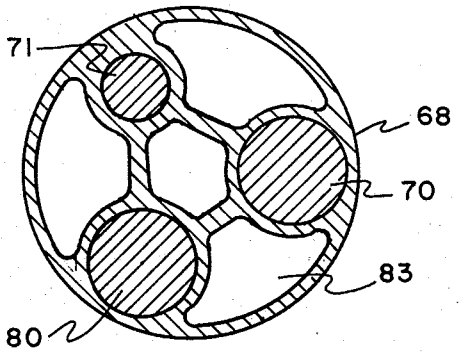
FIG. 2 is a cross-sectional view of the compressor means end of the cooler taken along lines 2—2 in FIG. 1.

The compressor means 12 produces pressure waves in a working fluid between a plurality of compression volumes 84, 86 and 88 and regenerators 36, 28, and 30 respectively of the regenerator means. Feed lines for the compression volumes and regenerators are respectively 42, 38, and 40. Look now more closely at the compressor means, it can be seen that as swash plate 20 rotates, piston rods 94, 102, and 120 are simultaneously linearly driven since the piston rods are connected by a clamp and ball bearing sliding means, e.g. 100 for piston rod 94, onto the swash plate. At the opposite ends of piston rods 94, 102, and 120 are respectively the compression cylinders 70, 80, and 71 which alternately produce the pressure waves in the compression volumes 88, 84, and 86 that are alternately fed to the regenerators 30, 36, and 28 respectively. It should be noted that the cold station 22 is kept at a more even temperature with the alternate cooling of regenerators 30, 36, and 28. Cylinders 70, 80, and 71 respectively have rings 72, 82, and a ring (not shown in FIG. 1) around cylinder 71. Bellows are attached to the low pressure side of the compression cylinders between the piston rods and the housing 68 to prevent contamination of the working fluid in the compression volumes by the lubricant, such as cryogenic grease, in the cavity 90 that lubricates the moving parts between the swash plate 20 and the piston rods. Two types of bellows are shown. One is bellows 96 which is secured, such as by welding, at point 97 on piston rod 94 and at point 99 on the interior of housing 68. Alternatively, bellows 104 may be secured to piston rod 102 at point 98 the same as was point 97 but at the other end of the bellows 104 are welds between the bellows and the housing at point 89 to form a flexible length 106 to provide good overall flexibility to bellows 104. FIG. 2 not only shows the relative placement of the three cylinders about 120° apart but illustrates the cavity volumes, represented by numeral 83, through which a coolant such as water may be constantly circulated to remove the heat buildup around the compression cylinders. It should further be noted that the cylinders may or may not be of the same overall size since the demand by the various regenerators may vary, especially since as shown and discussed with reference to FIGS. 3 and 4 the demands of different stages in a multistage, i.e. three stages as discussed, cooler or the different output power of separate coolers, such as ¼ watt, ½ watt, or 1 watt may vary greatly. The maximum diameter of a cylinder may be about 1 inch diameter. The diameters of the regenerator matrix areas may be typically from 3/16 inch to ½ inch.

The regenerator means of FIG. 1 will now be explained. The cavity 26 forming the dewar is first evacuated by connecting a vacuum thereto at stem 16 whereupon the stem 16 is then pinched off to hold the vacuum therein. An outer housing 32 and an inner housing 34 are connected together in an air tight means of holding the vacuum in cavity 26. It should be noted that insulation may fill cavity 26, or a floating insulation means, such as by electropolishing or gold plating the inside walls of the cavity 26, may also retain the cryogenic temperature inside the regenerator area. The regenerators 28, 30, and 36 may be held and spaced from each other by a convenient retainer means 119. The cold station 22 is attached in the cavity 26 to the outer portion of the inside housing 34. Looking at FIGS. 7*a* and 7*b* it can be seen that the regenerator swash plate 18 is different from the compressor swash plate 20. Swash plate 18 has a flat top portion 19 on the upper inclined portion 17 which when rotated against the ends of the plurality of displacer shafts alternately produces flat top pressure waves for the displacer shafts and thus the displacer motions. This flat top 19 is preferably about 35% of the entire distance around the inclined portion 17 and flat top 19 of the regenerator swash plate 18, i.e. around the entire 360° of the slider face of the swash plate 18. The ball bearing ends of the three displacer shafts 27, 29, and the one not shown but that functions with regenerator 36 (not shown in FIG. 1 but shown in FIG. 6) may be called the riders and the face of the regenerator swash plate 18, which comprises the inclined portions 17 meeting at the flat top 19, may be called the slider. The swash plate 18 preferably has a constant stroke length of ⅛ inch for all of the regenerator displacers.

Bellows are also connected to the displacer shafts to prevent contamination of the working fluid in the regenerators by the lubricant, i.e. preferably a cryogenic grease or oil in cavity 92 that lubricates the swash plate 18, i.e. the slider, and the swash plate 18, i.e. the slider, and the displacer ball bearings ends riding against the face of swash plate 18, i.e. the riders. The bellows are shown numerically as numerals 130 and 132 for displacer shafts 29 and 27 respectively and for regenerator 36 piston shaft (not shown). As an example for all bellows, bellows 130 may be welded at points 136 and 138 respectively to shaft 29 and to the inside housing 34. It should be noted that the compressed working fluid within the various regenerators keep the displacer shaft biased back on the face of swash plate 18.

Figure 6:
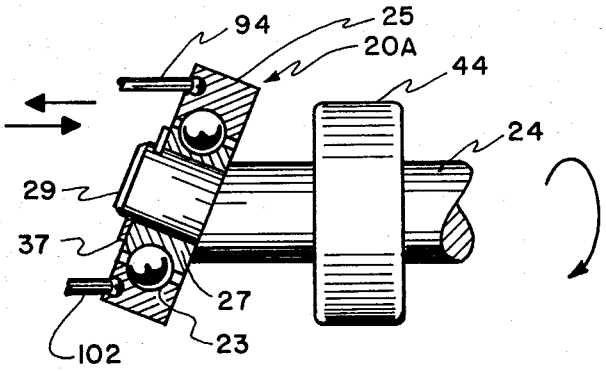
FIG. 6 shows an alternate embodiment of the compressor swash plate.
Figure 7B:
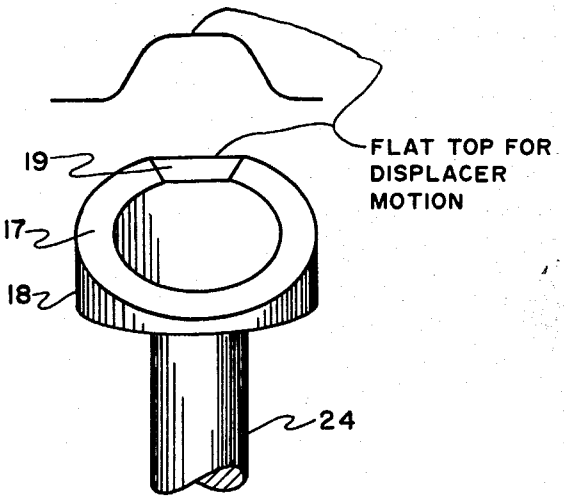
Figure 7A:
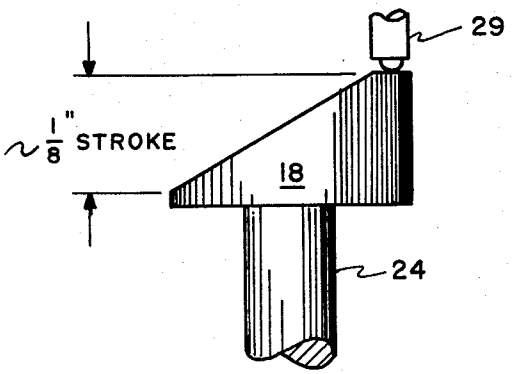

FIG. 6 illustrates an alternate compressor swash plate 20*a* wherein a pin 29 is welded to the end of shaft 24 at an oblique angle and has a rotary bearing comprised of an inner ring 27 that is also hard connected to shaft 24 and perhaps held to pin 29 with retainer ring 37 and a rotary bearing 23 upon which an outer ring 25 rides. With this swash plate 20*a*, pin 29 and ring 27 rotate with the rotating shaft 24 and drives the outer ring 25 that is stationary, i.e. non-rotating, but drives the piston rods, e.g. rods 94 and 102, in the linear motion as indicated by the heavy arrows for piston 94. The ball bearing ends of the piston rods may be press fitted into ring 25 to provide pull to the piston rods on the return.

While several embodiments of the invention have been shown and described it is to be understood that other variations and alterations may be made while remaining within the spirit and scope of the invention which is limited only by the following claims.

I claim:

1. A swash plate driving means for cryogenic coolers, said driving means comprising:

a shaft rotating means having at least one swash plate on the shaft rotated thereby;

compressor means comprised of a plurality of piston rods interacting between said at least one swash plate and compression cylinders to produce pressure waves in a plurality of compression volumes; and a regenerator means in a separate housing from said compressor means, said regenerator means comprised of a plurality of displacer regenerators operatively interacting with at least said pressure waves of said compressor means to provide cooling at a cold station within said regenerator means.

2. A driving means as set forth in claim 1 wherein said shaft rotating means is an electric motor which drives a shaft having a compressor swash plate on one end that interacts with said plurality of piston rods in said compressor means and a regenerator swash plate on the other end that interacts with said plurality of displacer regenerators in said regenerator means to provide an integral Stirling cycle cryogenic cooler wherein said plurality of displacer regenerators receive said pressure waves from said compressor means and is simultaneously driven by said regenerator swash plate.

3. A driving means as set forth in claim 2 wherein said plurality of piston rods are equally spaced and operate off both sides of said compressor swash plate and said plurality of displacer regenerators operate off both sides of said regenerator swash plate.

4. A driving means as set forth in claim 2 wherein said regenerator swash plate has a slider face thereon that operates as a slider for the ends of the plurality of displacer shafts operable with the plurality of displacer regenerators that ride thereon whereby rotation of said regenerator swash plate transmits reciprocating linear motion of said displacer shafts.

5. A driving means as set forth in claim 4 wherein the slider face of said regenerator swash plate has inclined portions meeting at a flat top portion wherein said flat top portion provide flat tops pressure waves for said plurality of displacer regenerators.

6. A driving means as set forth in claim 5 wherein said flat top portion is about 35% of the distance the ends of each displacer shaft travels around said slider face.

7. A driving means as set forth in claim 6 wherein said plurality of piston rods have bellows secured to the low pressure side between said rods and the housing of said compressor means and said plurality of displacer shafts have bellows secured between said shafts and the housing of said regenerator means to prevent contamination of cryogenic cooler working fluid with the lubricant used in the cavities where said swash plates operate.

8. A driving means as set forth in claim 7 wherein said compressor swash plate further has a slider face comprised of inclined portions meeting at a flat top portion which is 35% of the distance that the ends of each of said plurality of pistons travels around said slider face.

9. A driving means as set forth in claim 7 wherein said compressor swash plate is comprised of a pin connected by welding means at the end of said shaft at an oblique angle and having a rotary bearing surrounding said pin wherein said rotary bearing is comprised of an inner ring that is hard connected to said pin and end of shaft and a bearing upon which an outer ring rides when said inner ring is rotated by said shaft wherein said outer ring has the ball bearing ends of said plurality of piston rods press fitted into said outer ring whereby said outer ring imposes reciprocal linear motion to said plurality of piston rods.

10. A driving means as set forth in claim 7 wherein said plurality of piston rods and compression cylinders are evenly spaced around said compressor swash plate and said plurality of displacer shafts and regenerator displacers are evenly spaced around said regenerator swash plate.

11. A driving means as set forth in claim 10 wherein the dimensions of said plurality of compression cylinders and said displacer regenerator may be different.

12. A driving means as set forth in claim 1 wherein said regenerator means is comprised of a plurality of separate regenerators with each of said plurality of separate regenerators workably connected by working fluid feed lines from said plurality of compression volumes to provide a plurality of split Stirling cycle cryogenic coolers.

13. A driving means as set forth in claim 1 wherein said regenerator means is comprised of a cluster of regenerators within one dewar with each regenerator of said cluster of regenerators workably connected by working fluid feed lines from said plurality of compression volumes to provide a split Stirling cycle cryogenic cooler.

14. A driving means as set forth in claim 1 wherein said regenerator means is comprised of multistage precooled regenerator wherein one each of said fluid feed lines from said compressor means are connected to an input of each regenerator of said multistage precooled regenerator to provide a split Stirling cycle cryogenic cooler.

* * * * *